US011700931B2

(12) United States Patent
Jouan et al.

(10) Patent No.: US 11,700,931 B2
(45) Date of Patent: Jul. 18, 2023

(54) WIPER FOR LIQUID PRODUCT APPLICATOR

(71) Applicant: QUALIPAC, Clichy (FR)

(72) Inventors: Frédéric Jouan, Moriers (FR); Alim El Hassain, Saint Ouen (FR)

(73) Assignee: QUALIPAC, Clichy (FR)

( * ) Notice: Subject to any disclaimer, the term of this patent is extended or adjusted under 35 U.S.C. 154(b) by 0 days.

(21) Appl. No.: 17/547,631

(22) Filed: Dec. 10, 2021

(65) Prior Publication Data

US 2022/0183443 A1 Jun. 16, 2022

(30) Foreign Application Priority Data

Dec. 14, 2020 (FR) ..... 2013198

(51) Int. Cl.

| | |
|---|---|
| ***A45D 34/04*** | (2006.01) |
| ***A45D 40/26*** | (2006.01) |
| ***B01L 3/02*** | (2006.01) |
| ***B65D 47/18*** | (2006.01) |
| ***B65D 51/32*** | (2006.01) |

(52) U.S. Cl.

CPC ..... *A45D 34/046* (2013.01); *A45D 40/267* (2013.01); *B01L 3/021* (2013.01); *B65D 47/18* (2013.01); *B65D 51/32* (2013.01)

(58) Field of Classification Search

CPC .. A45D 34/045; A45D 34/046; A45D 34/047; A45D 40/265; A45D 40/267; A45D 40/268; B01L 3/021; B65D 47/18; B65D 51/32

USPC ..... 401/121, 122, 126–130

See application file for complete search history.

(56) References Cited

U.S. PATENT DOCUMENTS

| | | | | |
|---|---|---|---|---|
| 3,817,637 | A * | 6/1974 | Vasas | A45D 34/046 401/122 |
| 4,609,300 | A * | 9/1986 | Robert | B65D 51/32 401/122 |
| 4,627,454 | A * | 12/1986 | Dahm | B65D 51/32 132/320 |
| 7,182,535 | B2 * | 2/2007 | Lim | A45D 40/267 401/122 |
| 8,801,310 | B2 * | 8/2014 | Kulik | A45D 34/046 401/122 |

(Continued)

FOREIGN PATENT DOCUMENTS

| | | | |
|---|---|---|---|
| FR | 3005835 | A1 | 11/2014 |
| FR | 3016274 | A1 | 7/2015 |
| KR | 20200135235 | A | 12/2020 |

*Primary Examiner* — David J Walczak

(74) *Attorney, Agent, or Firm* — Maier & Maier, PLLC

(57) ABSTRACT

A wiping device for a fluid product applicator including a first part forming a support, a second part forming a wiping sleeve, the wiping sleeve making it possible to wipe an applicator stick immersing in a liquid product, the first part forming a support including an annular base resting on a mouth of the container, with an axial bearing collar and a tubular portion, the second part forming a wiping sleeve including a central passage and a wiping lip, with a plurality of legs extending from the annular base towards the sleeve, the legs being separated by secondary passages, which are located radially outside the sleeve and radially inside the tubular portion of the base, with an upper wiping lip having a free edge arranged in a plane located in the vicinity of the upper plane of the collar of the base.

15 Claims, 4 Drawing Sheets

(56) References Cited

U.S. PATENT DOCUMENTS

| | | | | |
|---|---|---|---|---|
| 9,642,442 | B2 * | 5/2017 | Pires | A45D 34/046 |
| 2012/0039660 | A1 * | 2/2012 | Suzuki | A45D 40/267<br>401/122 |

* cited by examiner

WIPER FOR LIQUID PRODUCT APPLICATOR

FIELD

The invention relates to the field of wiping devices for product applicators, in particular for cosmetic products, in particular for liquid products. A liquid product, intended to be applied, e.g., to the skin of a user is contained in a container, and an applicator is used to withdraw the product from the container and then apply it to the skin or any element, after which the applicator is reinserted into the container. We are particularly interested in the case where the applicator in question consists of a pipette and in the wiping device which makes it possible to avoid spilling drops of liquid in an undesirable manner.

BACKGROUND

FR3029080 discloses an arrangement with a pipette-type applicator. However, the wiping member which is promoted therein, with multiple helical lips, is complex and expensive to manufacture, and has a large axial dimension. To avoid a piston-like or air pump-like effect, it is assumed that air will be able to circulate between the helical lips, which requires a suboptimal geometrical compromise.

There therefore remains a need to offer more interesting solutions.

SUMMARY

Thus, there is proposed a wiping device for a liquid product applicator, wherein the device has an axis A, comprising:

a first part forming a support, a second part forming a wiping sleeve, the wiping sleeve being adapted to scrape an applicator stick immersing in a liquid product, the first part forming a support comprising an annular base configured to rest on a mouth of the container, with an axial bearing collar and a tubular portion centered on axis A and intended to be radially mounted inside the mouth, the second part forming the wiping sleeve comprising a central passage and at least one wiping lip (23, 24, 25), the first part forming a support comprising a plurality of legs extending from the annular base towards the second part forming a wiping sleeve, the legs being separated from each other by secondary passages, these secondary passages being located radially outside the wiping sleeve and radially inside the tubular portion of the base, and at least one upper wiping lip is provided which has a free edge arranged in a docking plane (P0) located in the vicinity of the upper plane of the collar of the base.

As a result, the secondary passages readily allow air and/or liquid to pass through, and thus the piston effect is avoided, and, moreover, the liquid product is advantageously allowed to flow back down through the secondary passages if product trickles from an upper region or if product is present in an upper area of the sleeve.

In addition, thanks to the upper wiping lip position, the stick is being scraped over its entire length, in particular up to the level of the closure disc provided in the applicator head.

As will be discussed later, it should be noted that the aforementioned first and second parts may form part of a single piece or alternatively may each be a piece separate from the other.

The term "wiper" can simply be used to designate the wiping device.

Under the term "scrape an applicator stick", it should also be understood "scrape a stick and wipe an applicator".

Note that the tubular portion does not necessarily have a shape of revolution. The cross-section may have a shape other than circular, for example oval, hexagonal, octagonal, square, or the like. The tubular portion is adapted to conform to the interior space available in the mouth of the container. The same applies to the bearing collar.

It should be noted that the wiping lip(s) (23; 24; 25) has/have a circular free edge intended to come into circular contact with the applicator stick. This makes it possible to obtain excellent compactness along the axis, even with two or three lips acting one after the other.

In various embodiments of the invention, one may optionally also implement one and/or the other of the following arrangements, taken individually or in combination.

According to an option, the total passage sectional area of said secondary passages (15) is greater than 3 $mm^2$, preferably greater than 4 $mm^2$, and even more preferably greater than 5 $mm^2$. The passage sectional areas are herein viewed in a plane transverse to the axis. In particular for the progression of the liquid from top to bottom parallel to the axis A.

According to an option, the total passage sectional area of said secondary passages may be greater than the sectional area of the legs taken in a plane transverse to the axis, preferably at least twice the sectional area of the legs. In the constrained space which surrounds the sleeve, it is thus proposed to devote the majority of this space to the secondary passages.

According to an option, the sleeve may include a first wiping lip (23) and a second wiping lip (24), their respective free edges being separated by a distance H2. Said distance H2 may be at least equal to 150% of the stick diameter, or said distance H2 may be at least equal to 9 mm.

Good on-axis guidance is thus provided for the applicator stick. This also reinforces the system perceived quality.

According to an option, said first wiping lip (23) and second wiping lip (24) are oriented in reversed orientation with respect to each other. The scraping actions thus complement each other.

According to a so-called bi-piece option, the first part forming a support is a first piece made of a first material and the second part forming a wiping sleeve is a second piece made of a second material, the second material being more flexible than the first material. As a result, there is a wide possibility of adjusting the flexibility of the lips to the intended applications.

According to a so-called single-piece option, the first part forming a support and the second part forming the wiping sleeve are made from a single piece. As a result, the cost of the wiper can be especially advantageous.

In an option, the first piece comprises a central ring (12) and the second piece comprises an outer annular channel (21) adapted to receive the central ring in a form-fitting manner. This geometry is adapted to allow good mutual hold of the first and second parts and to form the secondary passages.

According to an option, one of the first piece or the second piece is overmolded on the other of the first piece or the second piece.

Thanks to this, a robust assembly is achieved, and complex shapes can be achieved at the interface. It is possible to optimize the shapes, in particular to maximize the passage sectional areas of the secondary passages for a given diameter of the bottle mouth and for a given diameter of the applicator stick.

According to an option, it may be provided that one of the first piece or the second piece is clipped on the other of the first piece or the second piece.

Thereby, an assembly is formed which is easy to assemble, reversibly or not. It is also possible to achieve industrial modularity, i.e., a base reference (i.e. first piece) can be combined with several different sleeve references, or conversely, a sleeve reference (i.e. second piece) can also be combined with various different base references.

According to an option, there may be provided an annular spring arranged around one or several wiping lip(s). Thanks to this/these spring(s), fatigue/creep of the lip(s) is avoided. The service life is improved as well as the consistency of the scraping efficiency over time.

According to one option, it may be provided that the second part forming a wiping sleeve includes two wiping lips. Scraping redundancy and an increase in the wiping efficiency are thus obtained.

According to one option, it may be provided that the second part forming a wiping sleeve includes three wiping lips. Scraping redundancy and an increase in the wiping efficiency are thus obtained, in addition to guiding being reinforced.

According to one option, it may be provided the first part is made of hard plastic material and the second part is made of elastomeric material.

Materials are then thus chosen optimized for each function.

According to one option, the number of legs which connect the base to the sleeve can be between 3 and 6.

According to one option, the cross-section of the legs, in a vertical plane, is an 'L'-shaped cross-section. This gives some flexibility to the assembly in order to avoid parasitic noises and if necessary for the wiping sleeve to snap-in.

According to one option, the legs as well as the secondary passages are evenly arranged and spaced around the axis. This promotes the liquid flowing back down regardless of the container inclination relative to the vertical.

The present invention also relates to a system comprising a wiping device as defined above and a fluid product applicator, wherein the applicator includes a stick, the stick having a local sectional area narrowing at the location of the resting position of one or several wiping lip(s).

The particular shape of the stick helps preventing fatigue/creep of the lip(s) where the lip edge is when the applicator is closed and/or screwed on.

BRIEF DESCRIPTION OF THE FIGURES

Other features, details and advantages of the invention will appear from the detailed description hereinafter, and from considering the enclosed drawings.

DETAILED DESCRIPTION

On the different figures, the same reference signs designate identical or similar features. For the sake of clarity in the description, some features will not necessarily be represented to scale.

Concerning the geometrical identification, the direction A designates the product axis, the bottle (e.g., the container) axis, the wiper axis, and that of the applicator stick. This axis A can be described as 'main' or 'longitudinal'.

Container

Figure 2:
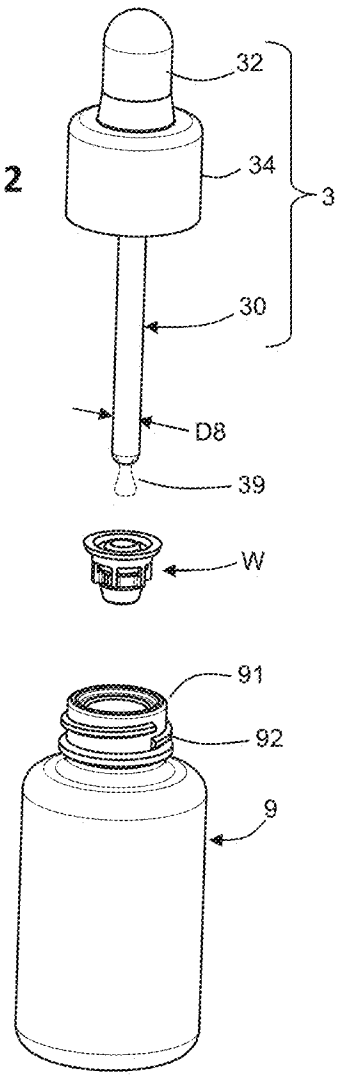
FIG. 2 illustrates in perspective and in exploded view the liquid cosmetic product bottle, the applicator and the wiper of FIG. 1.
Figure 1:
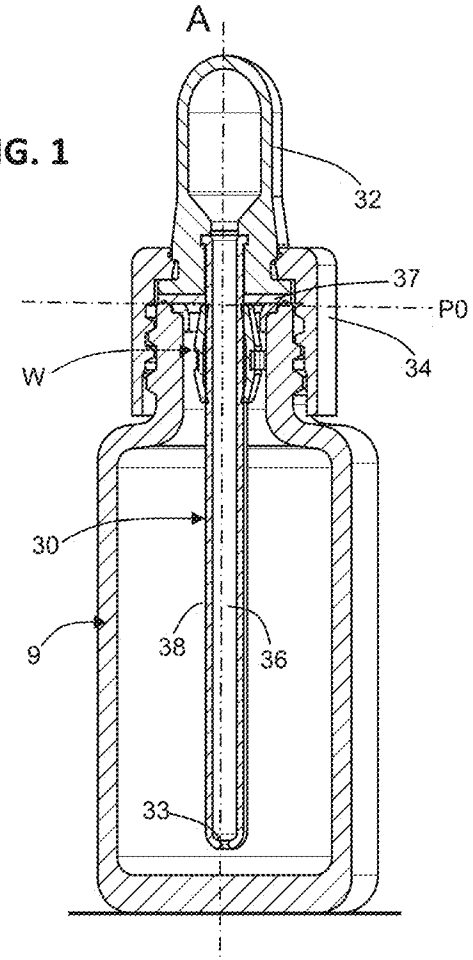
FIG. 1 illustrates in axial cross-section a liquid cosmetic product bottle, with an applicator and a wiper according to an embodiment of the invention.
Figure 4:
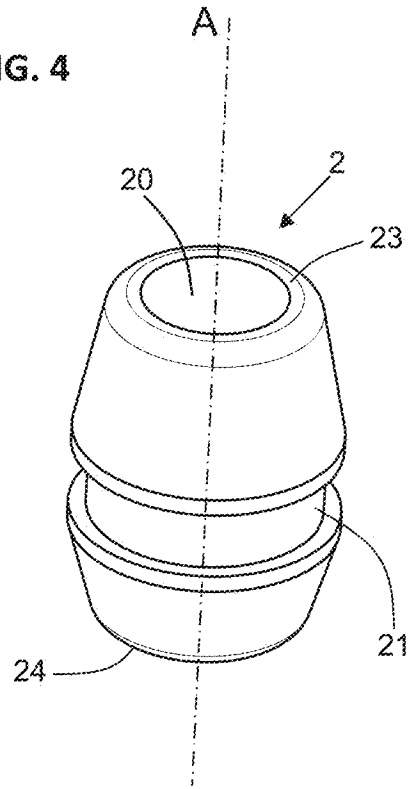
FIG. 4 illustrates in perspective the sleeve comprising two wiping lips.
Figure 3:
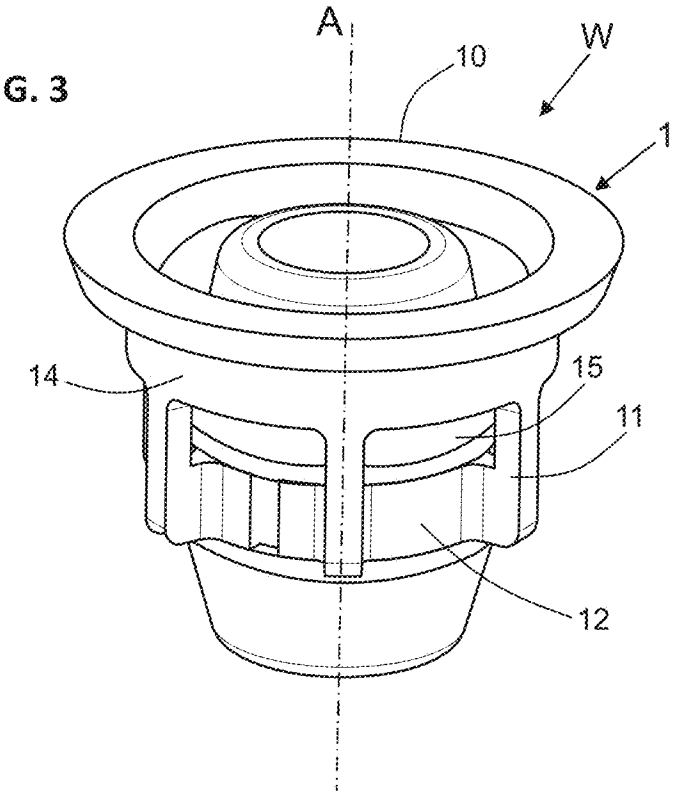
FIG. 3 illustrates in perspective a two-material embodiment of the wiping device.

The packaging and application system shown in FIGS. 1 and 2 comprises a container 9 containing the product to be applied, for example a makeup product such as a foundation, or alternatively a care product such as a serum care or an oil.

Instead of 'container', the terms 'bottle' or 'reservoir' can also be used to designate the container which contains the liquid product. It should be noted that the liquid product could be other than a cosmetic product, for example a drug, a decoration product, etc.

The container 9 can be made of glass or of synthetic plastic material or of thermoplastic material. This container 9 can be transparent or opaque.

The container capacity may typically be greater than 5 ml. In a range of particular applications, the container capacity may be between 20 ml and 100 ml.

According to the illustrated example, this container 9 is provided in the upper part with an outer threaded neck 92 with a free upper edge denoted 91. The free upper edge 91 is delimited by the docking plane P0. On the free edge, on the radially inner side, a seat 96 is provided to receive the base of the wiper, as will be seen below. The seat is annular and its face is substantially perpendicular to axis A; it is a little set back downwards with respect to the plane P0 to lodge a collar 17 of the annular base. Towards the interior, the seat is extended downwards by an internal wall 97 of the neck. This internal wall 97 is cylindrical of revolution about axis A. The inner diameter of this internal wall 97 is denoted D1.

The outer diameter of the neck (excluding the thread) denoted D0 is between 10 mm and 40 mm. Preferably, D0 will be between 12 mm and 24 mm for the typical targeted applications.

The annular base 10 can be held in the neck either by tight fitting the tubular portion 14, or by gluing between the collar 17 and the seat 96.

Applicator

In the illustrated example, the applicator 3 is of the pipette type. The applicator 3 comprises a hollow stick 30. The hollow stick 30 can be made of glass. Alternatively, the hollow stick 30 can be made of plastic. The hollow stick 30 has an interior volume 36 and a wall with a cylindrical exterior surface denoted 38. In the illustrated example, the hollow stick is of revolution around axis A.

The outer diameter D8 of the stick is constant over the majority of its height, D8 is between 2 mm and 10 mm, preferably between 3 mm and 8 mm. Preferably, D8 will be between 3 mm and 7 mm for the typical targeted applications. The stick length substantially corresponds to the container height as shown in FIG. 1.

In the upper part, a flexible bulb 32 is provided, made of an elastically deformable material, connected to the hollow stick 30. The bulb makes it possible to create, when it is pressed then released, a suction within hollow stick to draw some product contained in the container. The bulb 32 is centered on axis A.

A cover 34 is mounted on the bulb 32. The cover comprises a skirt with an internal thread provided to cooperate with the thread 92 of the container neck. The cover 34 and the bulb 32 are assembled for example by clipping.

The cover 34 is screwed onto the neck of the container 9 in the storage or non-use configuration.

A closing disc 37 is provided, which is in the form of a washer which extends perpendicularly to axis A between the diameters D6 and D0. The hollow stick passes through the closing disc. This disc 37 may be made of a flexible material so as to be slightly squeezed when the cover is screwed on. This disc 37 provides the sealing function of the system in the closed state. This disc 37 can be glued to a base of the bulb 32.

The hollow stick 30 has a bead at its upper end. This bead protrudes outward and allows the stick to be received into the bulb in a form-fitting manner or snap-fit. At the opposite end of the hollow stick, an opening 33 allows suctioning the liquid and delivering liquid.

An application member 39 such as a mini brush, a mini pad, or any other element for applying a particular product or to a particular anatomical location may also be provided at this lower end.

Wiping Device

Said wiping device W may also be called a "wiper" or "wiping member".

In the illustrated example, the wiping device W comprises a support-piece 1 (first piece) and a wiping sleeve 2 (second piece).

The support piece 1 comprises an annular base 10 configured to rest on the mouth of the container, e.g., more particularly on the already mentioned seat 96.

The annular base comprises an axially bearing collar 17 and a tubular portion 14. Both the collar 17 and the tubular portion are centered on axis A. The tubular portion 14 has an outside diameter D1 and an inside diameter D5. The tubular portion is mounted radially without play within the internal wall 97 of the neck.

A plurality of legs 11 extend downwards from the tubular portion. These legs are connected to a central ring 12. The legs support the central ring and the sleeve which is held therein; these legs are connecting legs or support legs.

The central ring 12 is centered on axis A. The number of legs 11 which connect the base to the sleeve is five in the example illustrated. However, according to another option, there could be 3 legs, 4 legs or 6 legs. However, having 2 legs or more than 6 legs is not excluded.

The legs 11 are evenly arranged and spaced in a circumferential direction.

The legs 11 are separated from another by large secondary passages 15. The sleeve 2 is adapted to wipe the applicator stick 30.

Figure 6:
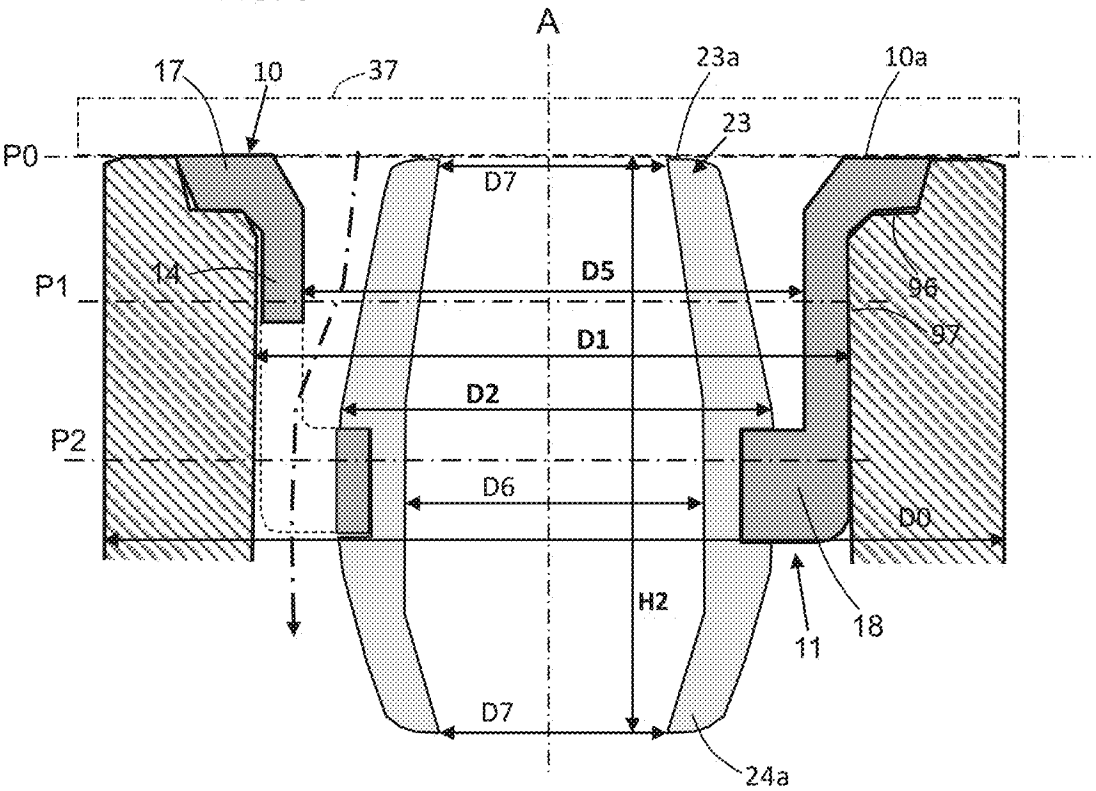
FIG. 6 illustrates in cross-sectional view an exemplary wiping device made in two pieces and comprising two lips.

More precisely, the wiping sleeve 2 comprises a central passage 20 for wiping the applicator stick 30, with, in the example illustrated in FIG. 6, two wiping or scraping lips, i.e., an upper lip 23 and a lower lip 24.

Figure 7B:
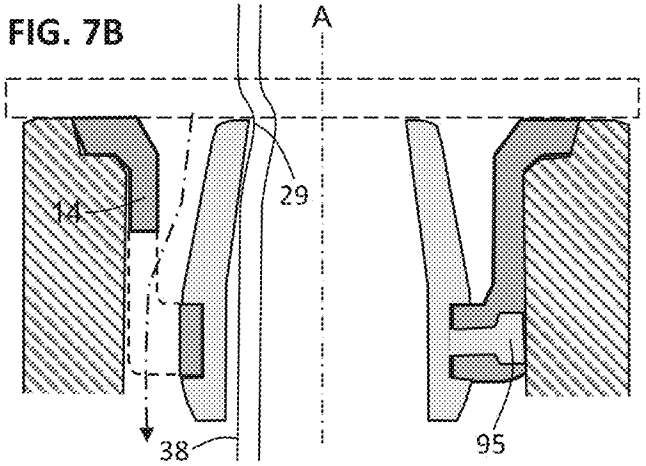
FIG. 7B illustrates in cross-section a variant with a single wiping lip and a portion with restricted sectional area on the applicator stick.
Figure 7D:
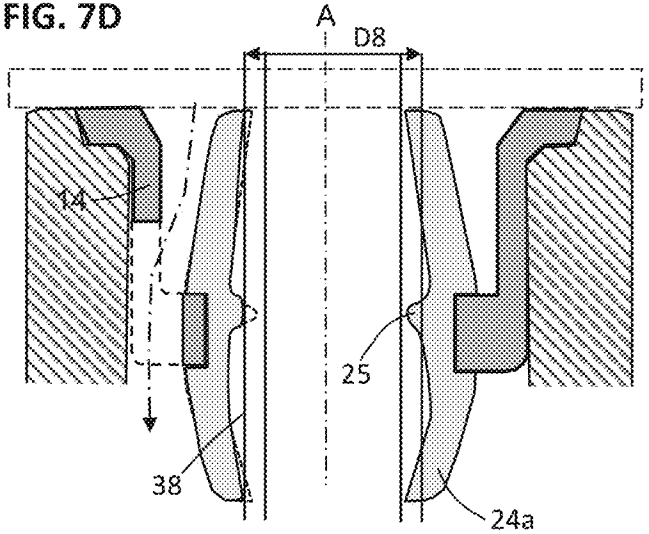
FIG. 7D illustrates in cross-sectional view a variant with three wiping lips.

More generally, the wiping sleeve 2 comprises at least one wiping lip, as illustrated in FIG. 7B on which only the upper lip 23 is provided.

The wiping sleeve 2 comprises an outer annular channel 21 adapted to receive the central ring 12 in a form-fitting manner.

Secondary Passages

As illustrated in the figures, note the secondary passages 15 are located radially outside the wiping sleeve 2 and radially inside the tubular portion 14 of the base, In a plane P1 located above the ring 12, there is a free passage over 360°. This passage is delimited radially outwards by the inner wall of the tubular portion 14 and delimited radially inwards by the outer wall of the sleeve 2.

Its passage sectional area is slightly greater than $\pi/4$ $(D5^2-D2^2)$.

Figure 5:
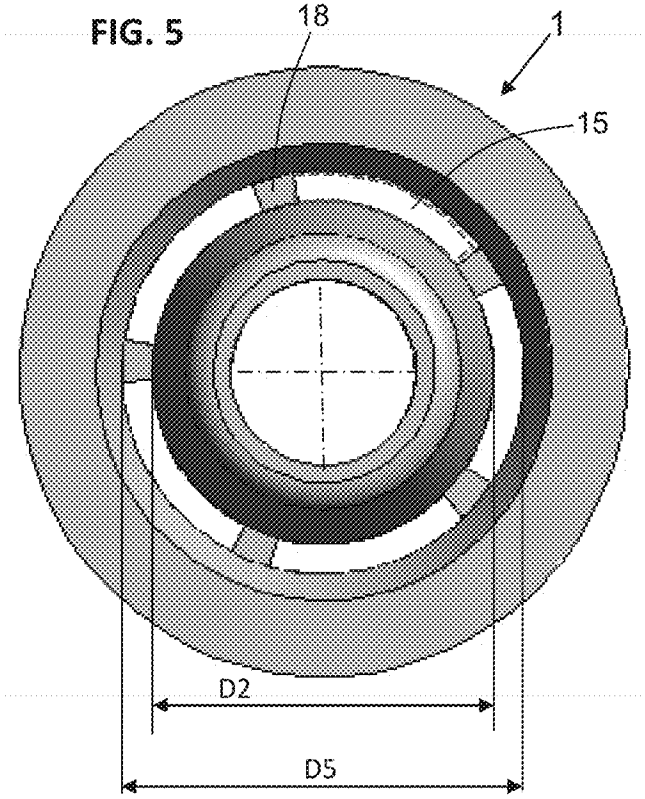
FIG. 5 illustrates, in a top view, in particular the secondary passages between the legs.

Lower, in a plane P2 located at the ring, the portions forming a radius 18 of the legs 11 obstruct the liquid passing, and the passage sectional area is then the total sectional area of the secondary passages as clearly visible in FIG. 5.

If the angular stretch of each radius is $\theta 1$, and N is the number of identical legs, then the obstruction sectional area of the legs is $Sobs=\pi/4\times(D5^2-D2^2)\times N\times\theta 1$ and the total sectional area passage for the liquid is $Sdisp=\pi/4\times(D5^2-D2^2)\times[2\pi-(N\times\theta 1)]$. If the legs are dissimilar or have more complex shapes, a similar summation or integral calculation can be performed.

As illustrated in FIG. 5, the total passage sectional area Sdisp of the secondary passages 15 is substantially greater than the sectional area of the legs Sobs taken in a plane transverse to the axis. In the illustrated example, the passage sectional area of the secondary passages 15 is greater than three times the sectional area of the legs.

In general, the passage sectional area of the secondary passages 15 may be chosen greater than twice the sectional area of the legs.

In general, the passage sectional area of said secondary passages 15 may be chosen greater than 5 $mm^2$, preferably greater than 6 $mm^2$.

The secondary passages 15 easily pass air and/or liquid, and thus the piston or 'air pump' effect is prevented.

In addition, the liquid product is advantageously allowed to flow back down through the secondary passages if product trickles from an upper region or if product is present in an upper region of the sleeve. As for the Vent' function, the large sectional area secondary passages makes it possible to prevent a possible 'sprinkling' effect when the air flow is fast. The inventors have in fact noticed that a small-dimension vent was not satisfactory. The liquid flowing back to the interior volume of the container is illustrated by the chain-dotted arrows in FIGS. 6 and 7A-7D.

FIG. 6 illustrates in cross-sectional view an exemplary wiping device with two lips and made in two distinct pieces. The first piece 1 is made of hard plastic material and the second piece 2 is made of elastomeric material. The first piece made of a first material, the second piece made of a second material. The second material is more flexible than the first material. The choice of the respective materials can thus be optimized.

To assemble the two pieces, one benefits from a substantial sleeve elasticity, wherein the sleeve can be deformed to be put into the ring 12 so that the groove 21 (annular channel) comes to be accommodated on either side of the central ring 12.

Figure 7A:
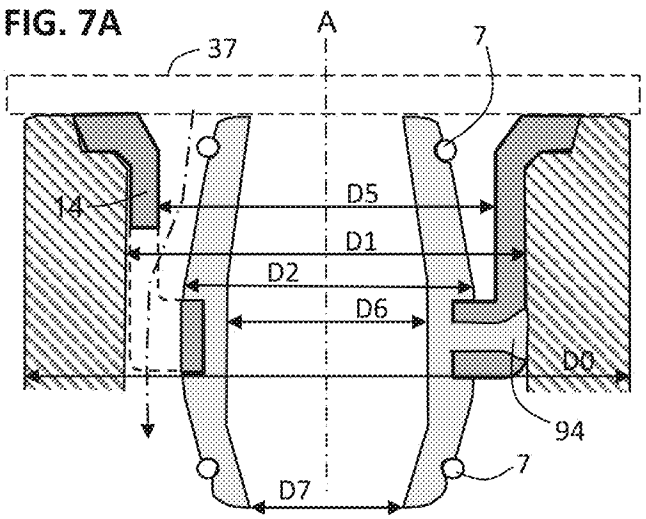
FIG. 7A is similar to FIG. 6 and illustrates in cross-sectional view a variant with annular springs.
Figure 7C:
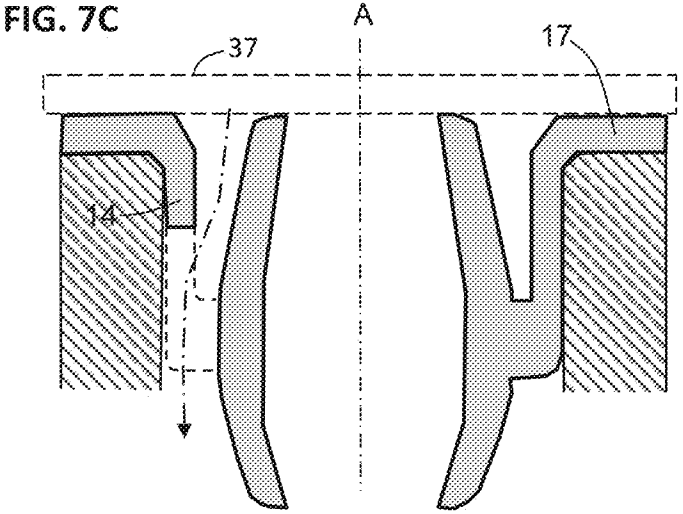
FIG. 7C illustrates in cross-sectional view a single-piece variant.

In an alternative solution illustrated in FIG. 7C, the wiping device W is made in a single piece.

It can be seen that the wiping lip(s) (23; 24; 25) has/have a circular free edge intended to come into circular contact with the applicator stick.

A spring 7 surrounds the distal portion of the lip. The spring tends to exert a constricting force around the lip, and the elasticity of the lip material is relieved by the action of the spring. One can choose an O-ring spring with a section of 1 to 1.5 mm.

The two upper and lower wiping lips (23, 24) are separated by a distance H2. Advantageously, distance H2 may be provided at least equal to 150% of diameter D8 of the stick. In one example, said distance H2 is selected at least equal to 9 mm. Good on-axis guidance is thus provided for the applicator stick.

Advantageously, the upper wiping lip 23 faces upwards. In other words, it has at rest a frustoconical shape circumscribed in a cone having an apex situated far above (low angle at the apex).

The free edge 23*a* of this lip is flush under the docking plane P0.

In the illustrated example, the lower wiping lip 24 faces downwards. In this case, it has at rest a frustoconical shape circumscribed in a cone having an apex situated far below (low angle at the apex). However, the lower wiping lip 24 could be generally radial or even oriented upwards.

Other Various and Optional Points

In an option, there can be three lips. The third wiping lip denoted 25 is radial in the example illustrated in FIG. 7D. This third lip is located halfway between the first and the second lip. It further improves the positive guiding effect of the applicator stick.

In FIG. 7B, it can be seen that the applicator stick has a sectional area restriction 29 where the lip is located at rest (applicator in the closed position). Thus, most of the time, the lip is in a resting position and its material is not stressed by an elastic deflection. It is only during a translational movement of the applicator stick that the lip is deflected.

FIG. 7C shows the wiper manufactured out of a single piece. In this case, the material selected is flexible with regard to the required function for the lip(s). The collar has a greater surface and can extend up to diameter D0. An annular string of glue is deposited between the upper edge of the neck and the collar of the wiper.

Regarding the manufacturing process, when the wiper contains two distinct materials, there may be two pieces clipped together as already described above, but there may be two pieces formed together by an overmolding operation, such as illustrated on the right sides of FIGS. 7A and 7B.

In this case, the legs may be wider in the circumferential direction and the legs are provided with recesses intended to be occupied by the flexible material in continuity with the sleeve.

More specifically, a recess is provided in each leg 11, the size of which increases when getting away from the axis (reference numbers 94, 95). During overmolding, the flexible material of the second piece fills these cavities. This forms a mushroom for anchoring the second piece in the first one.

According to one example, a fairly rigid plastic such as polypropylene or polyethylene or polyamide is chosen for the first piece 1.

According to one example, for the second piece 2 is chosen from the family of elastomeric polymers, e.g., a styrenic polymer or a polystyrene-polyethylene-butylene, from the family of polymers generally by the acronym SEBS on the market.

According to one example, for the second piece 2, one can consider choosing a thermoplastic elastomer based on a polyether block amide. The general chemical structure of this polyether block amide is HO—(CO—PA-CO—O—PE-O)n-H, where PA is polyamide and PE is polyether.

According to one example, for a single-piece single-material solution, an elastomeric polymer of medium to high flexibility may be chosen, depending on the target application, for example a polystyrene-polyethylene-butylene polymer, from the family of polymers generally known by the acronym SEBS on the market.

According to another example, for a single-piece single-material solution, one can choose a thermoplastic elastomer based on a polyether block amide. The general chemical structure of this polyether block amide is HO—(CO—PA-CO—O—PE-O)n-H, where PA is polyamide and PE is polyether.

The invention claimed is:

1. A wiping device adapted for a fluid product applicator, wherein the wiping device has an axis A, comprising:

a first part forming a support, a second part forming a wiping sleeve, the wiping sleeve being adapted to scrape an applicator stick immersing in a liquid product, the first part forming a support comprising an annular base configured to rest on a mouth of a product container, with an axial bearing collar exhibiting an upper plane and a tubular portion centered on the axis A and intended to be radially mounted inside the mouth, the second part forming the wiping sleeve comprising a central passage and at least one first wiping lip, the first part forming a support comprising a plurality of legs extending from the annular base towards the second part forming a wiping sleeve, the legs being separated from each other by secondary passages, these secondary passages being located radially outside the wiping sleeve and radially inside the tubular portion of the base, wherein the first wiping lip has a first free edge arranged in a plane at the upper plane of the axial bearing collar of the base, and wherein the first wiping lip exhibits at rest a frustoconical shape.

2. The wiping device according to claim 1, wherein the total passage sectional area of said secondary passages is greater than 3 $mm^2$.

3. The wiping device according to claim 1, wherein the sleeve comprises a second wiping lip having a second free edge, wherein the first and second free edges are separated from each other by a distance H2.

4. The wiping device according to claim 3, wherein an annular spring is provided arranged around the first wiping lip or the second wiping lip.

5. A system comprising a wiping device according to claim 3 and a fluid product applicator, wherein the applicator includes a stick, the stick having a local sectional area narrowing at location(s) of resting position(s) of the first wiping lip and/or the second wiping lip.

6. The wiping device according to claim 1, wherein the first part forming a support is a first piece made of a first material and the second part forming a wiping sleeve is a second piece made of a second material, the second material being more flexible than the first material.

7. The wiping device according to claim 6, wherein the second piece is a thermoplastic elastomer based on a polyether block amide.

8. The wiping device according to claim 6, wherein the first piece comprises a central ring and the second piece comprises an outer annular channel adapted to receive the central ring in a form-fitting manner.

9. The wiping device according to claim 6, wherein one of the first piece or the second piece is overmolded on the other of the first piece or the second piece.

10. The wiping device according to claim 6, wherein one of the first piece or the second piece is clipped on the other of the first piece or the second piece.

11. The wiping device according to claim 6, wherein the first piece is made of hard plastic material and the second piece is made of elastomeric material.

12. The wiping device according to claim 1, wherein the total passage sectional area of said secondary passages is greater than 5 $mm^2$.

13. The wiping device according to claim 1, wherein the first part and the second part are made integrally from a single piece.

14. The wiping device according to claim 13, wherein said single piece is a thermoplastic elastomer based on a polyether block amide.

15. The wiping device according to claim 1, wherein the frustoconical shape is circumscribed in a cone having an apex situated above.

* * * * *